US007515112B2

(12) United States Patent
Someya et al.

(10) Patent No.: US 7,515,112 B2
(45) Date of Patent: Apr. 7, 2009

(54) ANTENNA DEVICE AND RADIO WAVE CONTROLLED TIMEPIECE

(76) Inventors: Kaoru Someya, c/o Intellectual Property Department, Casio Computer Co., Ltd., Hamura R&D Center, 2-1, Sakae-cho 3-chome, Hamura-shi, Tokyo 205-8555 (JP); Kazuaki Abe, c/o Intellectual Property Department, Casio Computer Co., Ltd., Hamura R&D Center, 2-1, Sakae-cho 3-chome, Hamura-shi, Tokyo 205-8555 (JP)

( * ) Notice: Subject to any disclaimer, the term of this patent is extended or adjusted under 35 U.S.C. 154(b) by 83 days.

(21) Appl. No.: 11/714,386

(22) Filed: Mar. 6, 2007

(65) Prior Publication Data

US 2007/0210975 A1 Sep. 13, 2007

(30) Foreign Application Priority Data

Mar. 10, 2006 (JP) ..... 2006-065307

(51) Int. Cl.
*H01Q 7/08* (2006.01)

(52) U.S. Cl. ..... 343/788; 343/787; 343/718

(58) Field of Classification Search ..... 343/788, 343/787, 718

See application file for complete search history.

(56) References Cited

U.S. PATENT DOCUMENTS

| | | | | |
|---|---|---|---|---|
| 6,927,739 | B2 | 8/2005 | Nomura | |
| 7,126,548 | B2 | 10/2006 | Yano et al. | |
| 7,161,551 | B2 * | 1/2007 | Sano | 343/788 |
| 2004/0150578 | A1 | 8/2004 | Nomura | |
| 2005/0078045 | A1 | 4/2005 | Sano | |
| 2005/0156805 | A1 | 7/2005 | Yuda et al. | |

FOREIGN PATENT DOCUMENTS

| | | | |
|---|---|---|---|
| EP | 1 496 565 | A1 | 1/2005 |
| EP | 1 523 063 | A1 | 4/2005 |
| JP | 55-091237 | A | 7/1980 |
| JP | 55-91237 | A | 7/1980 |
| JP | 2005-311715 | A | 11/2005 |

OTHER PUBLICATIONS

Notification Concerning Transmittal of International Search Report and Written Opinion of the International Searching Authority dated Jun. 4, 2007, for PCT/JP2007/055013, 12 sheets.

* cited by examiner

*Primary Examiner*—Hoang V Nguyen

(57) ABSTRACT

An antenna device includes an antenna for receiving a time information radio wave, and an antenna support member. In the antenna, a coil is wound around a center portion of a core. In the support member, a non-magnetic portion supports two magnetic portions independently and both end portions of the core of the antenna are magnetically coupled with the magnetic portions. A radio wave controlled timepiece includes a case in an inner space of which the antenna and the support member are installed as described above. In the inner space, a time counting unit, a time display unit connected to the time counting unit, and a time updating unit configured to update the time displayed on the display unit, based on the time information radio wave received by the antenna, are installed.

11 Claims, 8 Drawing Sheets

ANTENNA DEVICE AND RADIO WAVE CONTROLLED TIMEPIECE

CROSS-REFERENCE TO RELATED APPLICATIONS

This application is based upon and claims the benefit of priority from prior Japanese Patent Application No. 2006-065307, filed Mar. 10, 2006, the entire contents of which are incorporated herein by reference.

BACKGROUND OF THE INVENTION

1. Field of the Invention

This invention relates to an antenna device and a radio wave controlled timepiece.

The antenna device used here comprises an antenna including a core and a coil wound around the core, and a structure that functions in cooperation with the antenna in order to improve receiving performance of the antenna.

2. Description of the Related Art

A radio wave controlled wristwatch which receives a radio wave including time information and automatically correct the current time is well known. In the radio wave controlled wristwatch, a small sized antenna is installed in a predetermined position of an inner space of a wristwatch case.

A structure for improving the receiving sensitivity of a small sized antenna is disclosed in Jpn. Pat. Appln. KOKAI Publication No. 55-91237. In this document, in order to attract more magnetic flux, a sectional area of each one of both end portions is set to be larger than that of a center portion around which a coil is wound in a core of the antenna. And, the antenna having the above described structure constitutes an antenna device.

When the whole wristwatch case is formed of a metal, the appearance of the wristwatch is improved, and the wristwatch looks like a high quality product. However, the metallic wristwatch case functions as a magnetic shield. Thus, in the case where the antenna is installed in an inner space of the metallic wristwatch case, the receiving sensitivity of the antenna may be significantly lowered.

Further, when a magnetic flux generated by the antenna which received a radio wave passes through the metallic wristwatch case, an eddy current may be generated with the wristwatch case. As a result, a loss occurs in the antenna coil and a Q value is lowered, and finally, the receiving sensitivity of the antenna may be significantly lowered.

A structure for preventing occurrence of the eddy current described above in the wristwatch case is disclosed in Jpn. Pat. Appln. KOKAI Publication No. 2005-311715 (and the corresponding U.S. Pat. No. 7,126,548). In this document, a magnetic member for restraining the generation of the eddy current is arranged between the antenna installed in the inner space of the metallic wristwatch case and a surface of the inner space of the wristwatch case. And, the antenna and the magnetic member described above configure the antenna device.

BRIEF SUMMARY OF THE INVENTION

An antenna device according to one aspect of the invention, comprises an antenna which includes an elongated core and a coil wound around a center portion of the core and which receives a radio wave including time information. And, the antenna device further comprises an antenna support member which includes two magnetic portions and a non-magnetic portion supporting the two magnetic portions independently of each other, both end portions of the core of the antenna being magnetically coupled with the two magnetic portions.

A radio wave controlled timepiece according to one aspect of the invention, comprises: a case which includes an inner space having an opening communicated with an outer space; an antenna which is installed in the inner space of the case, which includes an elongated core and a coil wound around a center portion of the core, and which receives a radio wave including time information; a time counting unit which is installed in the inner space of the case and which is configured to count a time; a time display unit which is installed in the inner space of the case, which is visible from the outer space through the opening, which is connected to the time counting unit, and which is configured to display the time; and a time updating unit which is installed in the inner space of the case and which is configured to update the time displayed on the time display unit, on a basis of the time information included in the radio wave received by the antenna. And, the radio wave controlled timepiece further comprises an antenna support member which is installed in the inner space of the case and which includes two magnetic portions and a non-magnetic portion supporting the two magnetic portions independently of each other, both end portions of the core of the antenna being magnetically coupled with the two magnetic portions.

A radio wave controlled timepiece according to another aspect of the invention, comprises: a case which includes an inner space having an opening communicated with an outer space; an antenna which is installed in the inner space of the case, which includes an elongated core and a coil wound around a center portion of the core, and which receives a radio wave including time information; a time counting unit which is installed in the inner space of the case and which is configured to count a time; a time display unit which is installed in the inner space of the case, which is visible from the outer space through the opening, which is connected to the time counting unit, and which is configured to display the time; and a time updating unit which is installed in the inner space of the case and which is configured to update the time displayed on the time display unit, on a basis of the time information included in the radio wave received by the antenna. And, the radio wave controlled timepiece further comprises an antenna support member which includes two magnetic portions and a non-magnetic portion supporting the two magnetic portions independently of each other, both end portions of the core of the antenna being magnetically coupled with the two magnetic portions, and the antenna support member configuring the case.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and detailed description of the embodiments given below, serve to explain the principles of the invention.

DETAILED DESCRIPTION OF THE INVENTION

First Embodiment of Each of Antenna Device and Radio Wave Controlled Wristwatch First, referring to FIGS. 1 to 4, a radio wave controlled wristwatch 100 according to a first embodiment of the present invention will be explained.

Figure 1:
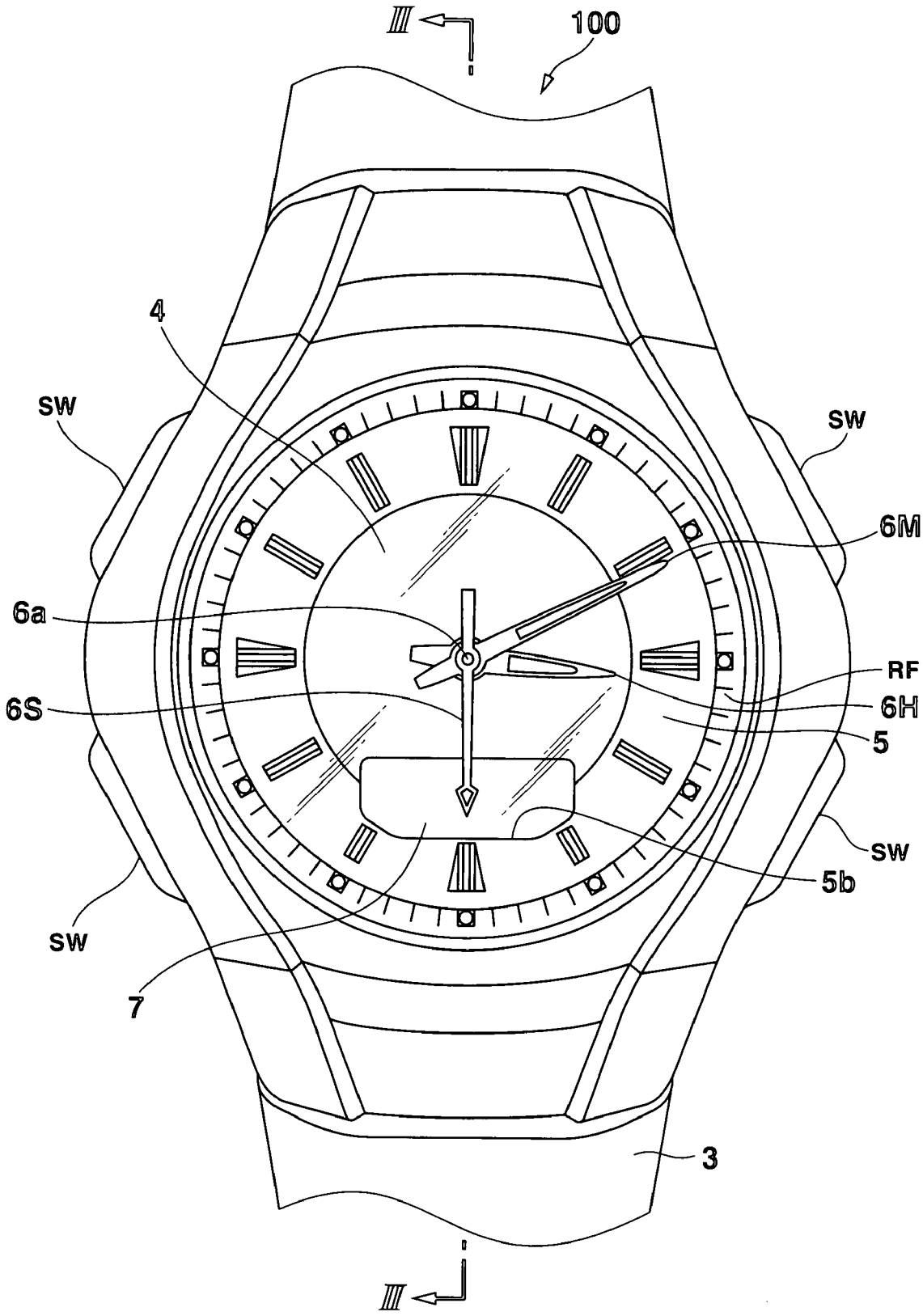
FIG. 1 is a plan view of a radio wave controlled wristwatch according to a first embodiment of the present invention.
Figure 2:
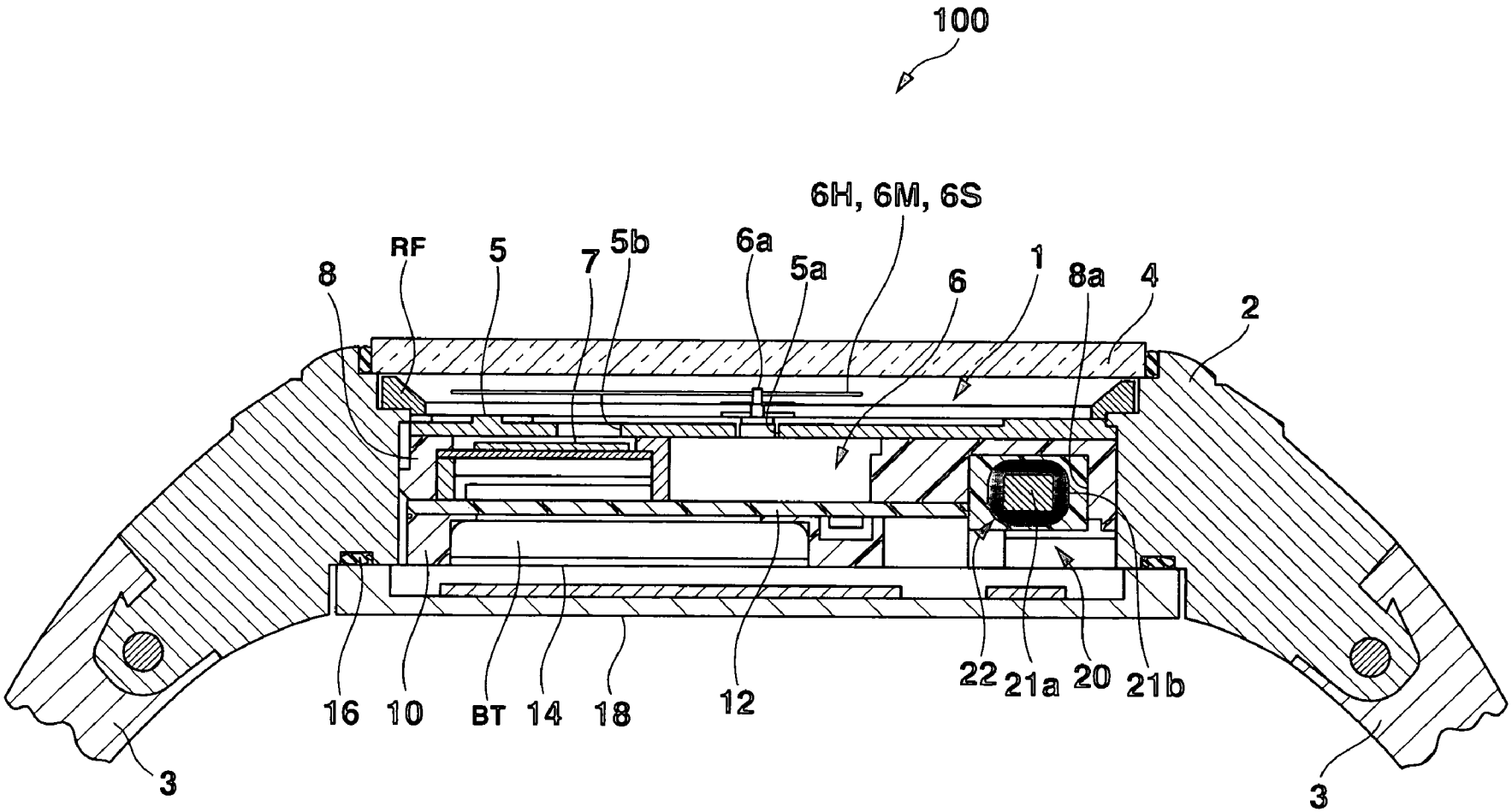
FIG. 2 is a sectional view taken along the line II-II of FIG. 1.
Figure 3:
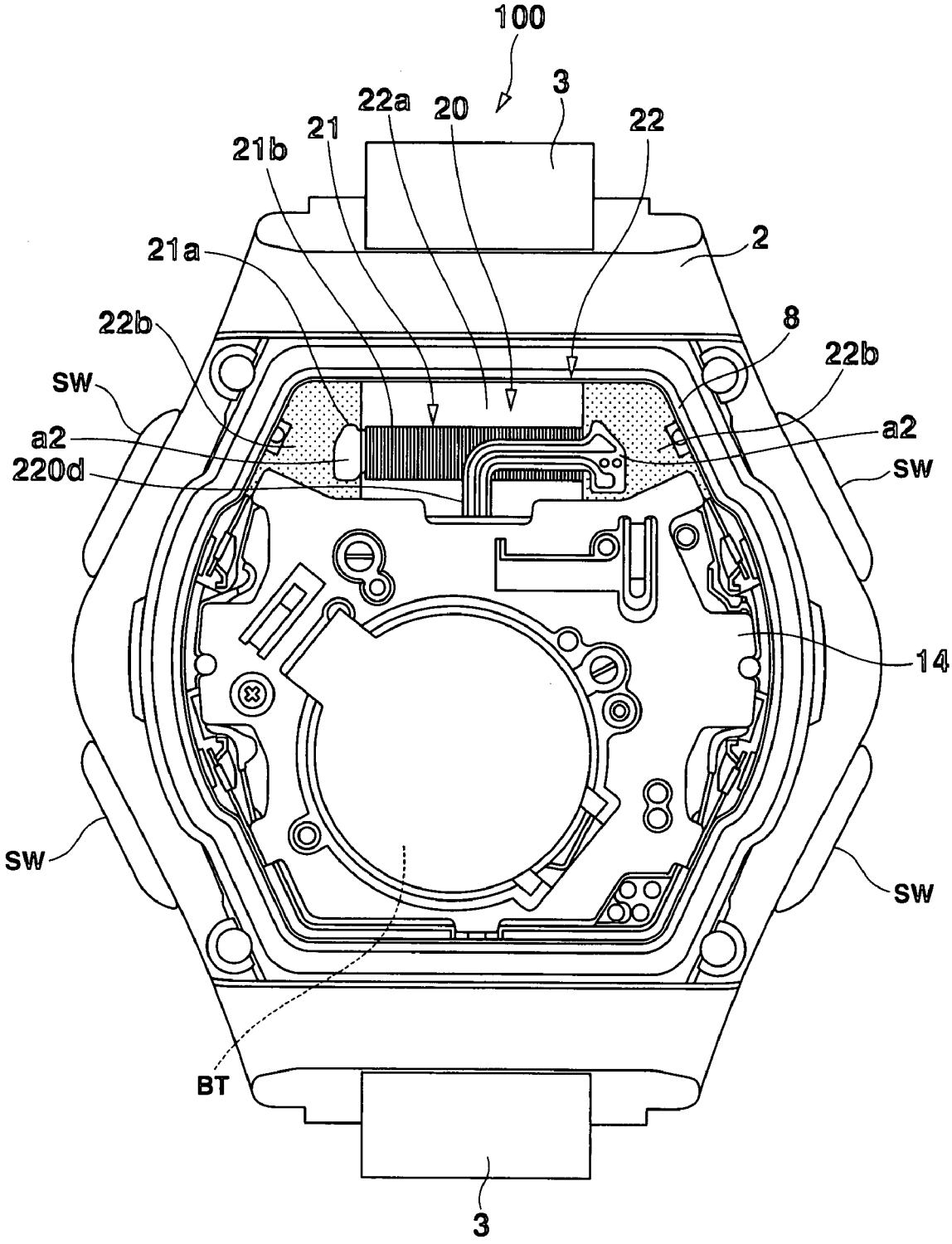
FIG. 3 is a rear view of the radio wave controlled wristwatch of FIG. 1, wherein a back cover of a wristwatch case is removed and an antenna device in an inner space of the wristwatch case is shown while a part of the antenna device is cut out.

As shown in FIGS. 1 to 3, the radio wave controlled wristwatch 100 is equipped with, for example, a metallic watch case 2 made of, for example, stainless or titanium. An inner space is formed in the wristwatch case 2 and the inner space is opened in front and back surfaces of the case. A timepiece block 1 is accommodated in the inner space.

Proximal ends of a pair of watch bands 3, 3 for wearing the radio wave controlled wristwatch 100 on a user's wrist are attached at two portions (i.e., 12 o'clock side and 6 o'clock side) positioned in opposite to each other on an outer periphery of the watch case 2. A plurality of input switches SW that cause the timepiece block 1 to perform a variety of functions are further provided on the outer periphery of the watch case 2.

The opening of the inner space in the front surface of the watch case 2 is covered with a watch glass 4, and the watch glass 4 is fixed to the opening. A dial plate 5 is disposed in the inner space immediately beneath the watch glass 4 via a circular frame member RF.

Further in the inner space, a hand moving mechanism 6 and a display panel (a liquid crystal display panel in this embodiment) 7 are disposed just under the dial plate 5. And, the hand moving mechanism 6 is located in the center of the inner space and the display panel 7 is located in the 6 o'clock position of the inner space.

A through hole 5*a* is formed in the center of the dial plate 5, and three concentric hand moving shafts 6*a* protruded from the hand moving mechanism 6 are inserted into the through hole 5*a*. Proximal ends of an hour hand 6H, a minute hand 6M, and a second hand 6S are fixed at the projected ends of three concentric hand moving shafts 6*a*.

A display window 5*b* is formed at a 6 o'clock position in the dial plate 5, and a screen of the display panel (the liquid crystal display panel in this embodiment) 7 is exposed in the display window 5*b*.

As shown in FIG. 2, the timepiece block 1 further includes an upper housing 8 and a lower housing 10 for holding a variety of timepiece block constituent elements that include the hand moving mechanism 6 and the display panel 7. The upper housing 8 and the lower housing 10 are independent of each other, are molded with a synthetic resin, and are detachably connected with each other by not shown well known connecting means.

In this embodiment, the upper housing 8 includes a large recess ranging from the center to the 6 o'clock position and a small recess 8*a* at the 12 o'clock position. The center of the large recess holds the hand moving mechanism 6, and the 6 o'clock position of the large recess holds the display panel 7. Further, the small recess 8*a* holds an antenna device 20. An opening for exposing the three concentric hand moving shafts 6*a* of the hand moving mechanism 6 is formed at the center of the upper housing 8, and another opening for exposing the screen of the display panel 7 is formed at the 6 o'clock position of the upper housing 8.

A circuit board 12 is sandwiched between the upper housing 8 and the lower housing 10. The lower housing 10 holds a battery BT for the hand moving mechanism 6, the display panel 7, and the circuit board 12.

In the inner space of the watch case 2, a housing fixing member 14 is disposed just under the lower housing 10. The housing fixing member 14 is removably fixed by well known fixing means at a position near to the back surface of the watch case 2 on the inner surface of the inner space, so that the ring shaped frame member RF, the dial plate 5, and the upper and lower housings 8 and 10 connected with each other are sandwiched by the watch glass 4 and the housing fixing member 14 in the inner space of the watch case 2.

The opening of the inner space in the back surface of the watch case 2 is covered with a back cover 18 fixed to the back surface via a waterproof ring 16.

Now, a control circuit of the radio wave controlled wristwatch 100 will be explained with reference to FIG. 4.

The control circuit is configured on the circuit board 12. The control circuit includes: a CPU (Central Processing Unit) 12*a*; and a RAM (Random Access Memory) 12*b*, a ROM (Read Only Memory) 12*c*, a time counting circuit 12*d*, and a receiving control circuit 12*e*, all of which are connected to the CPU (Central Processing Unit) 12*a*. The control circuit further includes an oscillation circuit 12*f* connected to the time counting circuit 12*d*.

The RAM 12*b* temporarily stores a variety of programs executed by the CPU 12*a* and data or the like relating to execution of these programs. The ROM 12*c* stores a variety of programs and data that cause the radio wave controlled wristwatch 100 to execute a variety of functions, in addition to a variety of initializing values and initializing programs.

The receiving control circuit 12*e* is connected to the antenna device 20. An input portion 12*g* that includes the plurality of switches SW disposed on the outer periphery of the watch case 2 and a display portion 12*h* that includes the display panel 7 and the hand moving mechanism 6 are further connected to the CPU 12*a*.

The time counting circuit 12*d* counts a current time on a basis of an electrical signal of a predetermined frequency oscillated from the oscillation circuit 12*f*. Therefore, the time counting circuit 12*d* and the oscillation circuit 12*f* configure a time counting unit TCU configured to count the current time.

The CPU 12*a* controls the display panel 7 and hand moving mechanism 6 of the display portion 12*h* to display the current time on a basis of current time data from the time counting unit TCU. Therefore, the display portion 12*h* configures a time display unit TDU connected to the time counting unit TCU via the CPU 12*a* and configured to display a time.

However, the display panel 7 of the display portion 12*h* can display a variety of information other than the current time on a basis of the program and data that CPU 12*a* reads out from ROM 12*c* in response to an input signal from the switches SW of the input portion 12*g*.

The antenna device 20 is configured to receive a predetermined radio wave that includes standard time information. The receiving control circuit 12*e* sends to the CPU 12*a* the standard time information included in the radio wave received by the antenna device 20, and causes the CPU 12*a* to update the time displayed by the time display unit TDU on a basis of the standard time information. In other words, the receiving control circuit 12*e* configures a time update unit TRU in cooperation with the CPU 12*a*.

A detailed functions of the control circuit will be described later.

Now, the antenna device 20 will be described with reference to FIG. 5.

Figure 5:
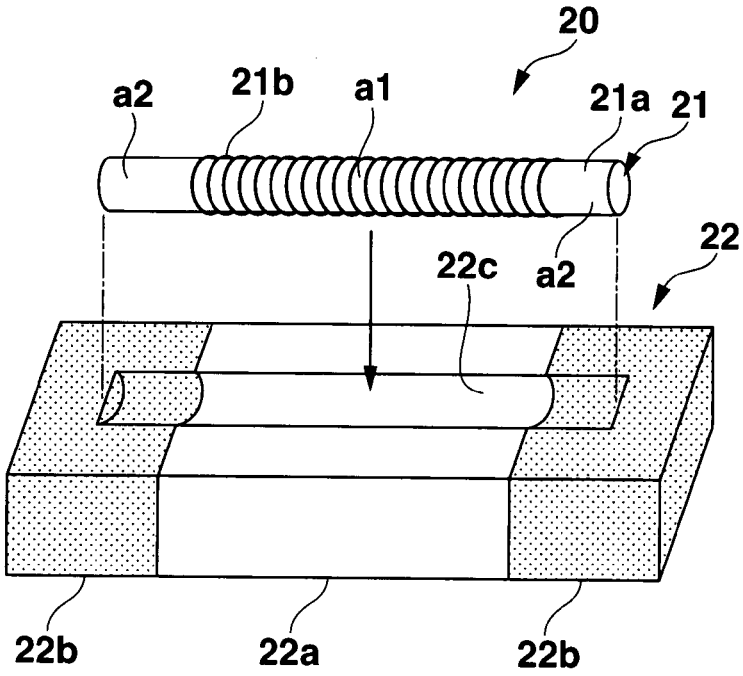
FIG. 5 is a perspective view showing a simplified structure of the antenna device which is used in the radio wave controlled wristwatch of FIG. 1.

FIG. 5 shows a structure of the antenna device 20 in a simplified manner. The antenna device 20 comprises an antenna 21 including an elongated core 21*a* and a coil 21*b* wound around a center portion a1 of the core 21*a*, and an antenna support member 22 made of resin to support the antenna 21.

The antenna support member 22 includes a non-magnetic portion 22*a* and two magnetic portions 22*b* and 22*b* independent of each other. The non-magnetic portion 22*a* is positioned between the two magnetic portions 22*b* and 22*b*, and supports the two magnetic portions 22*b* and 22*b* independently to each other. In detail, the non-magnetic portion 22*a* is formed of a resin that does not contain magnetic material, and the two magnetic portions 22*b* and 22*b* are integrally formed with the non-magnetic portion 22*a* at its both ends with a resin that contains magnetic material.

An antenna support recess 22*c* is formed in the antenna support member 22 to extend from one magnetic portion 22*b* to the other magnetic portion 22*b* through the non-magnetic portion 22*a*. The antenna 21 lies in the antenna support recess 22*c*, whereby both ends a2 of the core 21*a* of the antenna 21 are in contact with the two magnetic portions 22*b* and 22*b* and are magnetically coupled with the two magnetic portions 22*b* and 22*b*.

Figure 6:
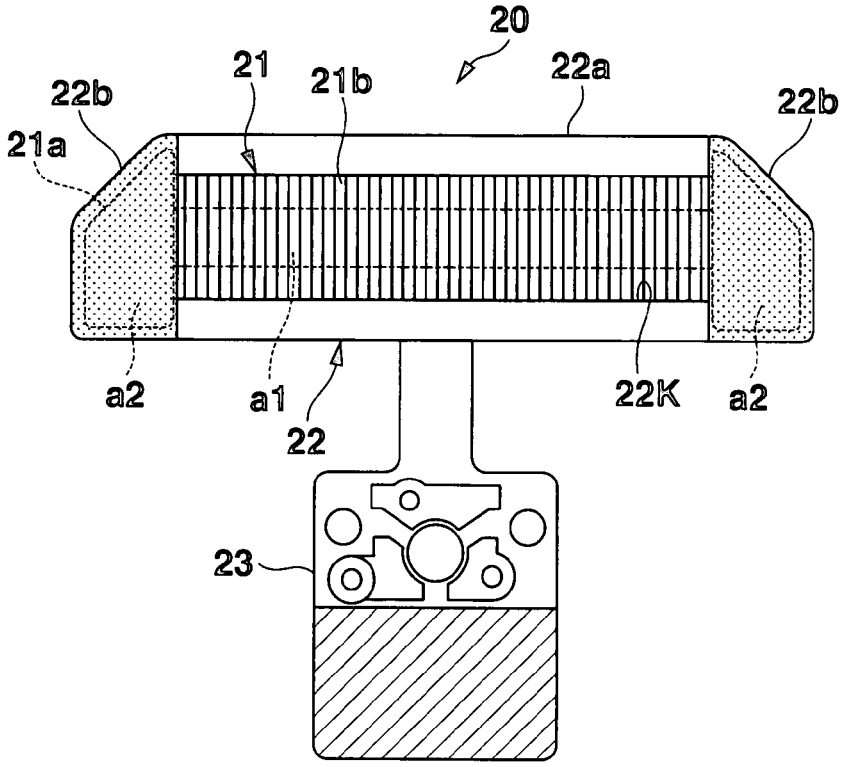
FIG. 6 is a plan view of a first embodiment of the antenna device which is used in the radio wave controlled wristwatch of FIG. 1.
Figure 7:
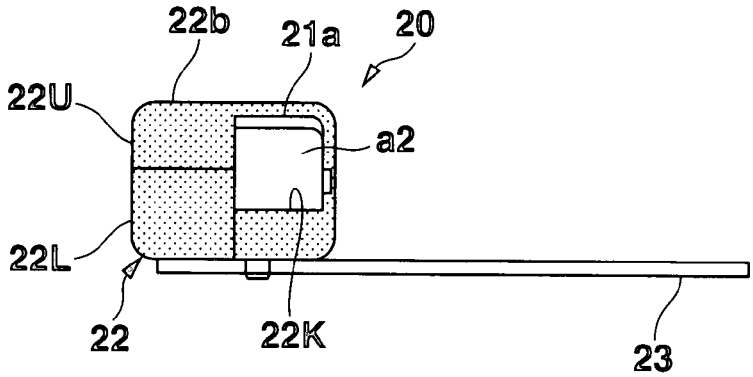
FIG. 7 is a side view of the first embodiment of the antenna device of FIG. 6.
Figure 8:
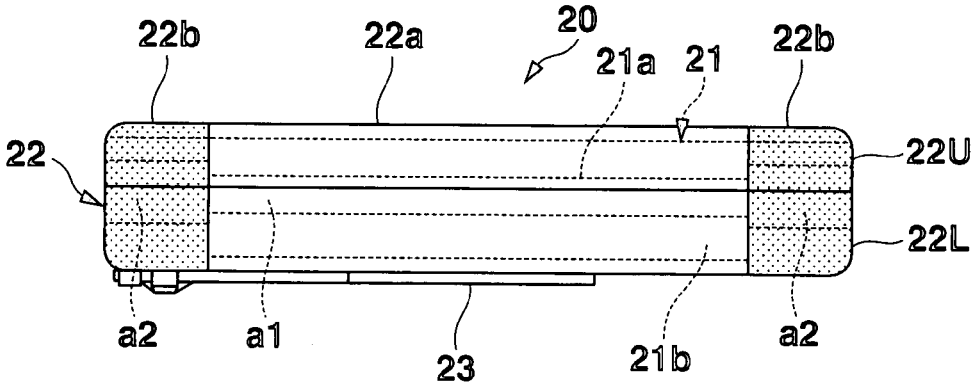
FIG. 8 is a front view of the first embodiment of the antenna device of FIG. 6.

Now, referring to FIGS. 6 to 8, a configuration of the antenna device 20 practically used in the radio wave controlled wristwatch 100 will be explained.

The core 21*a* of the practical antenna device 20 is formed of a magnetic material such as ferrite or amorphous, for example, having high radio wave receiving sensitivity, and includes a center portion a1 having a substantially rectangular cross section and end portions a2 each having a cross section that is slightly larger than that of the center portion a1 and formed integrally with the center portion 1*a* at each of the both ends thereof.

A non-electrically conductive resin (for example, fluorine resin) having a thickness of about 20 μm to 30 μm is coated on an outer surface of the core 21*a*, and the coil 21*b* is wound on the outer surface of the center portion 21*a* of the core 21 via a coat of the non-electrically conductive resin to have an uniform thickness. The coat of the non-electrically conductive resin may be formed only on the outer surface of the center portion 21*a*.

The antenna support member 22 includes an upper cover 22U that covers an upper half of the antenna 21 and a lower cover 22 that covers a lower half of the antenna 21.

In the upper cover 22U, an upper housing recess (not shown) in which the upper half of the antenna 21 is to be housed is formed in a contact surface that comes into contact with the lower cover 22L. In the lower cover 22L, a lower housing recess (not shown) in which the lower half of the antenna 21 is to be housed is formed in a contact surface that comes into contact with the upper cover 22U. A flexible board 23 is attached on a lower end surface of the lower cover 22L. Lead lines electrically connected to the terminals of the coil 21*b* of the antenna 21 are formed on the flexible board 23.

The upper cover 22U and the lower cover 22L are fixed to each other by an adhesive.

An opening 22K is formed at a portion corresponding to the coil 21*b* of the antenna 21 in each of an upper end surface of the upper cover 22U and the lower end surface of the lower cover 22L, and at a portion corresponding to a part of each of the both ends of the core 21*a* of the antenna 21 in both of the left and right ends of each of the upper cover 22U and the lower cover 22L. The openings 22K serve to promote external diffusion of heat generated by the antenna 21 and to reduce a height of the antenna support member 22.

Both end portions of each of the upper cover 22U and the lower cover 22L are formed of a synthetic resin that contains magnetic material (for example, 20% by weight to 80% by weight), and configure the magnetic portions 22*b*. A center portion of each of the upper cover 22U and the lower cover 22L is formed of a synthetic resin that does not contain magnetic material, and configures the non-magnetic portion 22*a*. In each of the upper cover 22U and the lower cover 22L, the non-magnetic portion 22*a* is formed integrally with the two magnetic portions 22*b* positioned at the both ends of the non-magnetic portion 22*a*, and the non-magnetic portion 22*a* supports the corresponding two magnetic portions 22*b* independently to each other.

Therefore, while the antenna 21 is cover with the upper cover 22U and the lower cover 22L as described above, the both end portions 2*a* of the core 21*a* of the antenna 21 are in contact with the two magnetic portions 22*b* of each of the upper cover 22U and the lower cover 22L and are magnetically connected with these magnetic portions 22*b*.

It is preferable that the magnetic material contained in the synthetic resin that forms the magnetic portion 22*b* have higher magnetic permeability than that of the core 21*a*. The magnetic material may have a particle shape or a needle shape.

The magnetic material dispersed in the synthetic resin of the magnetic portion 22*b* causes the magnetic portion 22*b* to have magnetic permeability of a predetermined value that is sufficient for converging magnetic flux, and the synthetic resin prevents the lowering of the strength of the magnetic portion 22*b*.

When the antenna device 20 is placed in a magnetic field of the predetermined radio wave including the time information described previously, the magnetic fluxes of the magnetic field can be caught easily by the magnetic portions 22*b* each having higher magnetic permeability and larger sectional area than those of the core 21*a*, and is concentrated at the core 21*a*, and interlink with the coil 21*b*. Therefore, much more magnetic flux can be concentrated at the core 21*a* in comparison with a case in which the magnetic portions 22*b* are not provided. Thus, in comparison with the case in which the magnetic portions 22*b* are not provided, it is possible to cause the coil 21*b* to generate much larger inductive electromotive force. In other words, in comparison with the case in which the magnetic portions 22 are not provided, receiving sensitivity of the antenna device 20 is improved much more remarkably.

Figure 4:
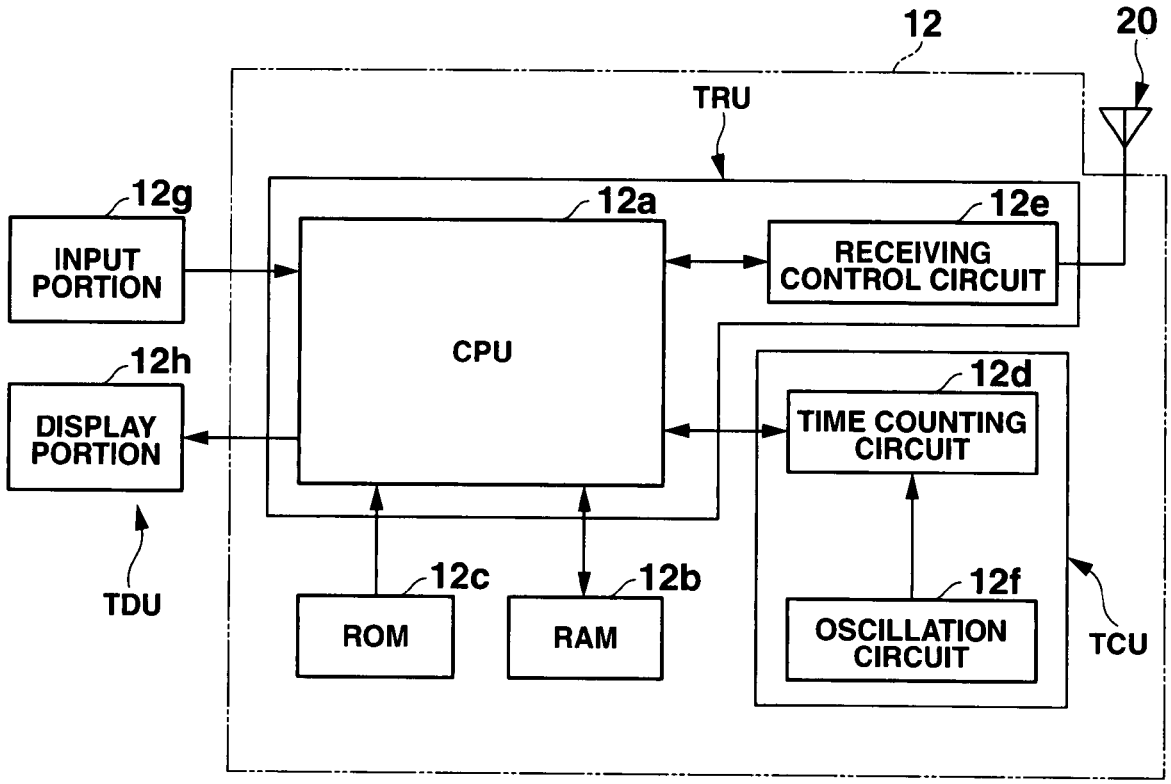
FIG. 4 is a block diagram of a control circuit of the radio wave controlled wristwatch of FIG. 1.

In the control circuit shown in FIG. 4, the receiving control circuit 12*e* cuts frequency signals other than that of the predetermined radio wave (standard time radio wave) that includes the time information among the frequency signals generated by the inductive electromotive force inputted from the antenna device 20, and obtains only the frequency signal (standard time frequency signal) that corresponds to the standard time radio wave. Further, the receiving control circuit 12*e* generates a standard time code that includes data relating to a current time such as a current year, month, and day code and a day of the week code, on a basis of this standard time frequency signal, and then, outputs the standard time code to the CPU 12*a*.

The CPU 12*a* selectively reads out a plurality of predetermined programs stored in ROM 12*c* and writes them in RAM 12*b* in response to a predetermined timing or an operating signal inputted from each of the plurality of switches SW of the input portion 12*g*, and executes a process based on the selected programs. Then, the CPU sends instructions, data, or the like to a variety of operating portions or circuits connected to the CPU 12*a*.

The CPU 12*a* having received the standard time code from the receiving control circuit 12*e* corrects the current time data sent from the time counting circuit 12*d* on a basis of the standard time code, and then, controls the display panel 7 and hand moving mechanism 6 of the display portion 12*h* to display a corrected current time on a basis of the corrected current time data.

As is apparent from the above detailed description, in the radio wave controlled wristwatch 100 according to the first embodiment, the receiving sensitivity of the antenna 21 is greatly amplified by the two magnetic portions 22*b* of the antenna support member 22 which are in contact with the both end portions of the core 21*a* of the antenna 21 and which are magnetically coupled with the both end portions. Therefore, even if the watch case 2 is metallic, the antenna 21 can sufficiently receive the standard time radio wave as described above.

Moreover, the two magnetic portions 22*b* are included in the antenna support member 22 that houses the antenna 21. Thus, the whole size of the antenna device 20 is reduced in comparison with the conventional case in which the both end portions of the core are expanded to improve the receiving sensitivity of the antenna and the antenna is housed in the antenna support member that does not have two magnetic portions. As a result, the radio wave controlled wristwatch 100 can be prevented from being large sized.

Further, the two magnetic portions 22*b* and the non-magnetic portion 22*a* in the antenna support member 22 are formed integrally with each other, thus simplifying a structure of the antenna support member 22 and facilitating manufacture of the antenna device 20 and manufacture of the radio wave controlled wristwatch 100 more significantly.

Second Embodiment of Antenna Device

Figure 9A:
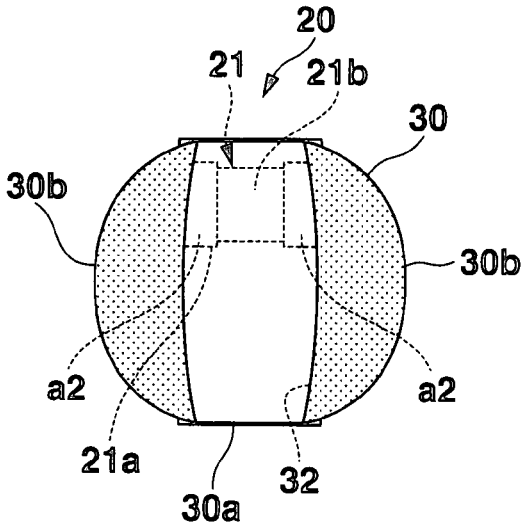
FIG. 9A is a plan view showing in a simplified manner an upper housing which is housed in an inner space of a wristwatch case of a radio wave controlled wristwatch and configures an antenna support member for supporting an antenna, wherein the upper housing serving as the antenna support member is combined with the antenna to provide a second embodiment of the antenna device.
Figure 9B:
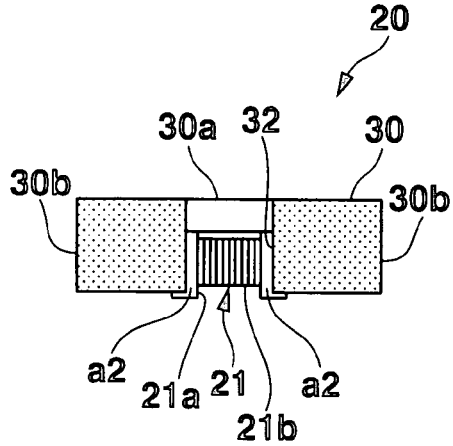
FIG. 9B is a front view of the simplified upper housing of FIG. 9A.

Next, referring to FIGS. 9A and 9B, an upper housing 30 which is used instead of the upper housing 8 housed in the inner space of the watch case 2 of the radio wave controlled wristwatch 100 according to the above described first embodiment, the upper housing 8 holding the antenna device 20.

In each of FIGS. 9A and 9B, the upper housing 30 is shown in a simplified manner.

In this embodiment, the antenna 21 is directly supported by the upper housing 30, and the upper housing 30 configures an antenna support member for supporting the antenna 21. The upper housing 30 serving as the antenna support member is combined with the antenna 21 to configure the second embodiment of the antenna device 20.

The upper housing 30 serving as the antenna support member includes an antenna housing recess 32 that houses the antenna 21. In the antenna housing recess 32, a center portion which is located near to the coil 21*b* of the antenna 21 is configured by a non-magnetic portion 30*a*. In the antenna housing recess 32, both end portions being in contact with the both end portions a2 of the core 21*a* of the antenna 21 are configured by two magnetic portions 30*b*. The non-magnetic portion 30*a* supports the two magnetic portions 30*b* independently to each other, and is formed integrally with the two magnetic portions 30*b*. The both end portions a2 of the core 21*a* of the antenna 21 housed in the antenna housing recess 32 are in contact with the two magnetic portions 30*b*, and are magnetically coupled with the two magnetic portions 30*b*. Each of the two magnetic portions 30*b* is formed of a synthetic resin that contains magnetic material, and the non-magnetic portion 30*a* is formed of a synthetic resin that does not contain magnetic material. The two magnetic portions 30*b* and the non-magnetic portion 30*a* are integrally formed.

Next, referring to FIGS. 10A and 10B, a configuration of the antenna device 20 according to the second embodiment and practically used in the radio wave controlled wristwatch 100 will be explained.

In the practical upper housing 30 (antenna support member) of the antenna device 20 according to the second embodiment, the non-magnetic portion 30*a* linearly extends from a 12 o'clock position to a 6 o'clock position. The two magnetic portions 30*b* are formed continuously at both linear side edges of the non-magnetic portion 30*a*, and each of the two magnetic portions 30*b* also extends from the 12 o'clock position to the 6 o'clock position.

The antenna housing recess 32 linearly extends from one magnetic portion 30*b* to the other magnetic portion 30*b* via the non-magnetic portion 30*a* at the 12 o'clock position of the upper housing 30. The antenna 21 housed in the antenna housing recess 32 is fixed in the antenna housing recess 32 by an adhesive. The coil 21*b* on the center portion a1 of the core 21*a* of the antenna 21 is located near to the non-magnetic portion 30*a*, and the both end portions a2 of the core 21*a* are in contact with the two magnetic portions 30*b* to magnetically connect to the two magnetic portions 30*b*.

In the center of the non-magnetic portion 30*a* of the upper housing 30, a hand moving shaft insertion hole 30*c* is formed into which the three coaxially hand moving shafts 6*a* of the of the hand moving mechanism 60 (refer to FIG. 2) held at a center of the upper housing 30 is inserted. In the 6 o'clock position of the non-magnetic portion 30*a*, a screen-exposing opening 36 is formed so as to expose the screen of the display panel 7 held at a 6 o'clock position of the upper housing 30.

In the first embodiment described previously, the antenna device 20 is configured by the antenna 21 being combined with the antenna support member 22 independent of the upper housing 8, and the both end portions of the antenna support member 22 configure the two magnetic portions 22*b* and the center portion thereof configures the non-magnetic portion 22*a*. In addition, the antenna device 20 configured as described above is further held in the recess 8*a* of the upper housing 8.

However, in the second embodiment, the antenna 21 is combined with the upper housing 30 serving as the antenna support member and configures the antenna device 20. Therefore, the antenna device 20 according to the second embodiment is much simple in configuration in comparison with the antenna device 20 according to the first embodiment, and a capacity required only for installation of the antenna device 20 (antenna device mounting capacity) is reduced in the inner space of the watch case 2. In addition, the radio wave controlled wristwatch 100 employing the antenna device 20 according to the second embodiment can be downsized more significantly in capacity of the inner space of the watch case 2 (i.e., in whole capacity of the watch case 2) in comparison with the radio wave controlled wristwatch 100 employing the antenna device 20 according to the first embodiment.

Moreover, in the upper housing 30, each of the two magnetic portions 30*b*, linearly extending from the 12 o'clock position to the 6 o'clock position along the both side edges of the non-magnetic portion 30*a* that also linearly extends from the 12 o'clock position to the 6 o'clock position, has a much larger sectional area in comparison with each of the two magnetic portions 22 at the both end portions of the antenna support member 22 according to the first embodiment described previously. Therefore, the antenna device 20 according to the second embodiment is much higher in receiving sensitivity than that according to the first embodiment.

[First Modification of the Second Embodiment of the Antenna Device]

Figure 11A:
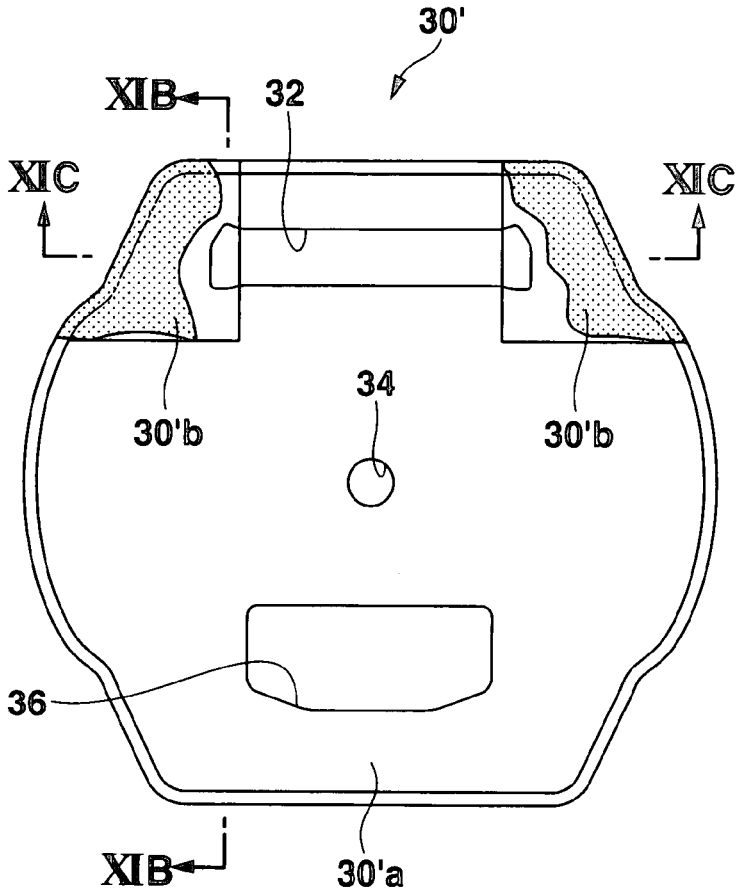
FIG. 11A is a rear view of a first modification of the embodied upper housing illustrated in each of FIGS. 10A and 10B, wherein parts corresponding to two magnetic portions are partially cut out in order to show the two magnetic portions.
Figure 11B:
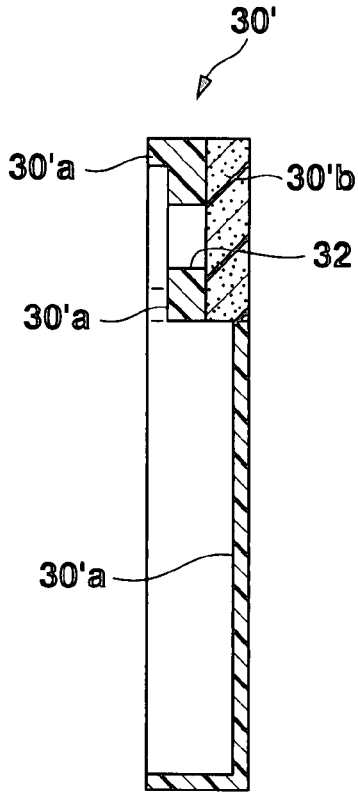
FIG. 11B is a sectional view of the first modification taken along the line XIB-XIB of FIG. 11A.
Figure 11C:
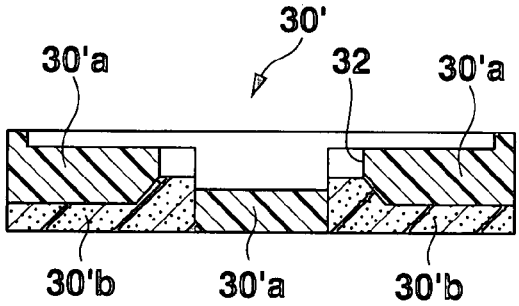
FIG. 11C is a sectional view of the first modification taken along the line XIC-XIC of FIG. 11A.

Next, referring to FIGS. 11A to 11C, a first modification of the upper housing 30 which is used, instead of the upper housing 8 housed in the inner space of the watch case 2 and holding the antenna device 20, in the radio wave controlled wristwatch 100 according to the first embodiment described above.

Figure 10A:
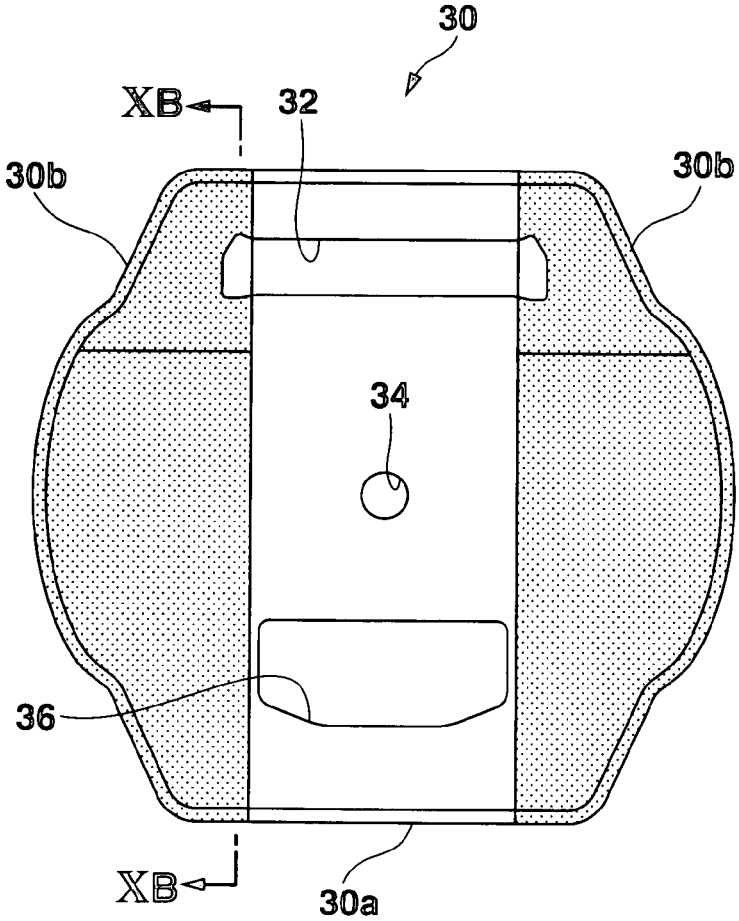
FIG. 10A is a rear view embodying the simplified upper housing illustrated in each of FIGS. 9A and 9B.
Figure 10B:
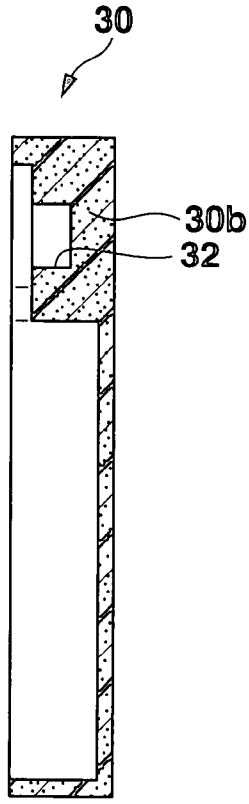
FIG. 10B is a sectional view of the embodied upper housing taken along the line XB-XB of FIG. 10A.

In a configuration of an upper housing 30' according to the first modification, constituent elements which are the same as those of the upper housing 30 shown in each of FIGS. 10A and 10B are designated by reference numerals which are the same as those designating the same constituent elements of the upper housing 30 shown in each of FIGS. 10A and 10B. And, a detailed description thereof will be omitted.

The upper housing 30' according to the first modification is different from the upper housing 30 in that two magnetic portions 30'*b* are disposed only at a front surface side of the upper housing 30' (i.e., at a side facing the dial plate 5 when the upper housing 30' is housed in the inner space of the watch case 2, as shown in FIG. 2) in two areas that correspond to the both end portions of the antenna housing recess 32 at a 12 o'clock position of the upper housing 30' (i.e., the both end portions a2 of the core 21*a* of the antenna 21 housed in the antenna housing recess 32). In the upper housing 30', a portion excluding the two magnetic portions 30'*b* is a non-magnetic portion 30'*a*.

The capacity of each of the two magnetic portions 30'*b* of the upper housing 30' according to the modification is much smaller than that of each of the two magnetic portions 30*b* of the upper housing 30 described previously. Therefore, the quantity of a synthetic resin containing comparatively expensive magnetic material, which is used in the upper housing 30', is much smaller than that in the upper housing 30 described previously. Moreover, in the upper housing 30', the two magnetic portions 30'*b* are disposed as described above, thereby making it possible to efficiently receive the standard time radio wave entering into the inner space described above from the opening at the front surface side at which the dial plate 5 is disposed in the inner space of the watch case 2.

[Second Modification of the Second Embodiment of the Antenna Device]

Figure 12:
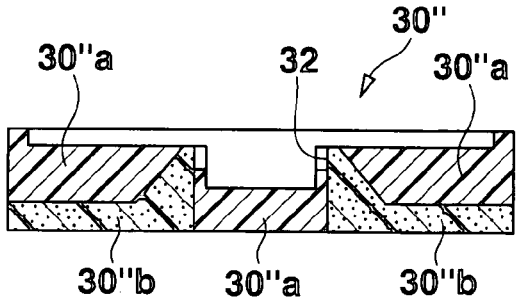
FIG. 12 is a sectional view similar to that of FIG. 11C, of a second modification of the upper housing illustrated in each of FIGS. 10A and 10B.

Next, referring to FIG. 12, a second modification of the upper housing 30 which is used, instead of the upper housing 8 housed in the inner space of the watch case 2 and holding the antenna device 20, in the radio wave controlled wristwatch 100 according to the first embodiment described above.

In a configuration of an upper housing 30" according to the second modification, constituent elements which are the same as those of the upper housing 30 shown in each of FIGS. 10A and 10B are designated by reference numerals which are the same as those designating the same constituent elements of the upper housing 30 shown in each of FIGS. 10A and 10B. And, a detailed description thereof will be omitted.

The upper housing 30" according to the second modification is different from the upper housing 30' according to the first modification in that only both ends in a longitudinal direction of an inner surface of the antenna housing recess 32 are specified by two magnetic portions 30"*b* and the remaining area of the inner surface of the antenna housing recess 32 is specified by a non-magnetic portion 30"*a*.

In this modification, the antenna 21 housed in the antenna housing recess 32 is magnetically coupled with the two magnetic portions 30"*b* by only both ends of the core 21*a* being in contact with the two magnetic portions 30"*b* of the upper housing 30".

The upper housing 30" according to the second modification and supporting the antenna 21 as described above also serves as the antenna support member and constitutes the antenna device 20 when the upper housing 30" is combined with the antenna 21.

The capacity of each of the two magnetic portions 30"*b* of the upper housing 30" according to this modification is much smaller than that of each of the two magnetic portions 30'*b* of the upper housing 30' of the first modification described previously. Therefore, the quantity of a synthetic resin containing a comparatively expensive magnetic material, which is used in the upper housing 30" of the second modification, can be further reduced in comparison with that in the upper housing 30' of the first modification described previously. Moreover, receiving efficiency of the standard time radio wave in the upper housing 30" of the second modification is not so different from that in the upper housing 30' of the first modification described previously.

Second Embodiment of the Radio Wave Controlled Wristwatch

Figure 13:
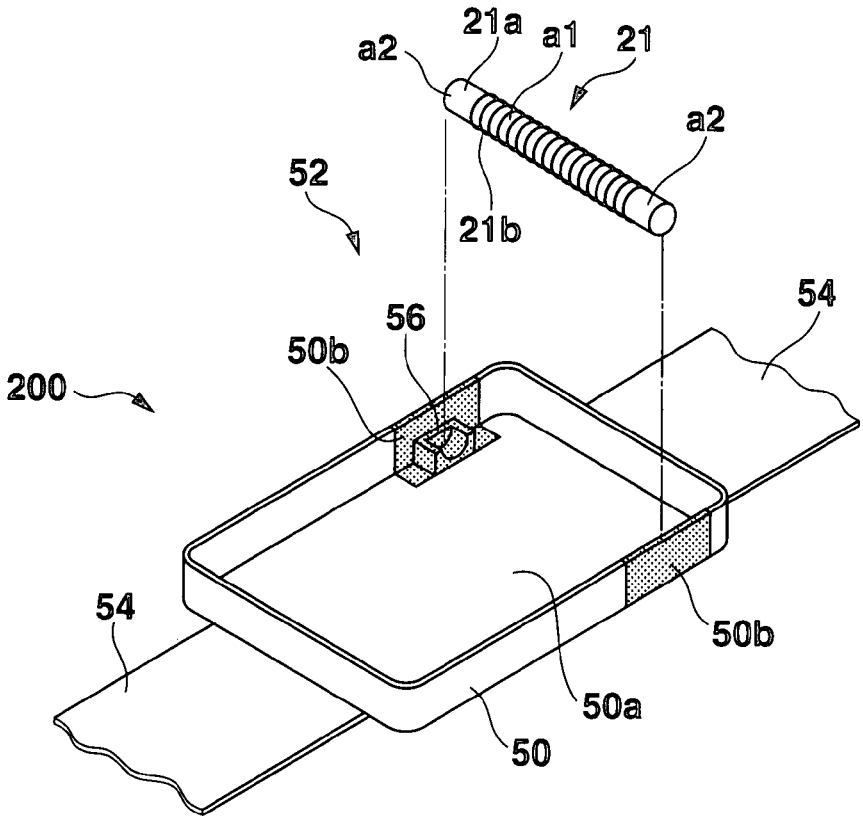
FIG. 13 is a simplified perspective view of a wristwatch case and an antenna device, both of which are essential portions of a radio wave controlled wristwatch according to a second embodiment of the present invention.

Next, referring to FIG. 13, a radio wave controlled wristwatch 200 according to a second embodiment of the present invention will be explained. FIG. 13 shows in a simplified manner a watch case 50 and an antenna device 52 both of which are main portions of the radio wave controlled wristwatch 200.

An inner space of the watch case 50 houses constituent elements, excluding the antenna device 20, in the timepiece block 1 accommodated in the inner space of the watch case 2 of the radio wave controlled wristwatch 100 according to the first embodiment shown in FIGS. 1 to 4.

Proximal ends of a pair of watch bands 54 are attached at a 12 o'clock position and a 6 o'clock position on an outer periphery of the watch case 50. Two antenna core support members 56 that support the both end portions a2 of the core 21 of the antenna 21 are disposed at a 12 o'clock position in the inner space of the watch case 50. At the 12 o'clock position, the two antenna core support members 56 are spaced from each other in a direction orthogonal to an imaginary line connecting the 12 o'clock position and the 6 o'clock position with each other along a bottom surface of the inner space of the watch case 50 (i.e., in a direction parallel to an imaginary line connecting a 3 o'clock position and a 9 o'clock position with each other).

In the watch case 50, any portion other than the two antenna core support members 56 described above and the areas surrounding the two antenna core support members 56 is configured as a non-magnetic portion 50*a*, and the two antenna core support members 56 and the areas surrounding the two antenna core support members 56 are configured as magnetic portions 50*b*. In the watch case 50, the non-magnetic portion 50*a* supports the two magnetic portions 50*b* independently to each other. In more detail, in the present embodiment, the non-magnetic portion 50*a* is formed of a resin that does not contain magnetic material, and each of the two magnetic portions 50*b* is formed of a resin that contains magnetic material. The non-magnetic portion 50*a* and the two magnetic portions 50*b* are integrally formed to configure the watch case 50.

When the both end portions a2 of the core 21*a* of the antenna 21 are supported by the two antenna core support members 56 of the watch case 50, the both end portions a2 of the core 21 of the antenna 21 are in contact with the two antenna core support members 56, and are magnetically coupled with the two magnetic portions 50*b* of the watch case 50.

In other words, in the present embodiment, the watch case 50 is configured as an antenna support member, and the watch case 50 as an antenna support member is combined with the antenna 21 to configure the antenna device 21.

Third Embodiment of the Antenna Device

Figure 14:
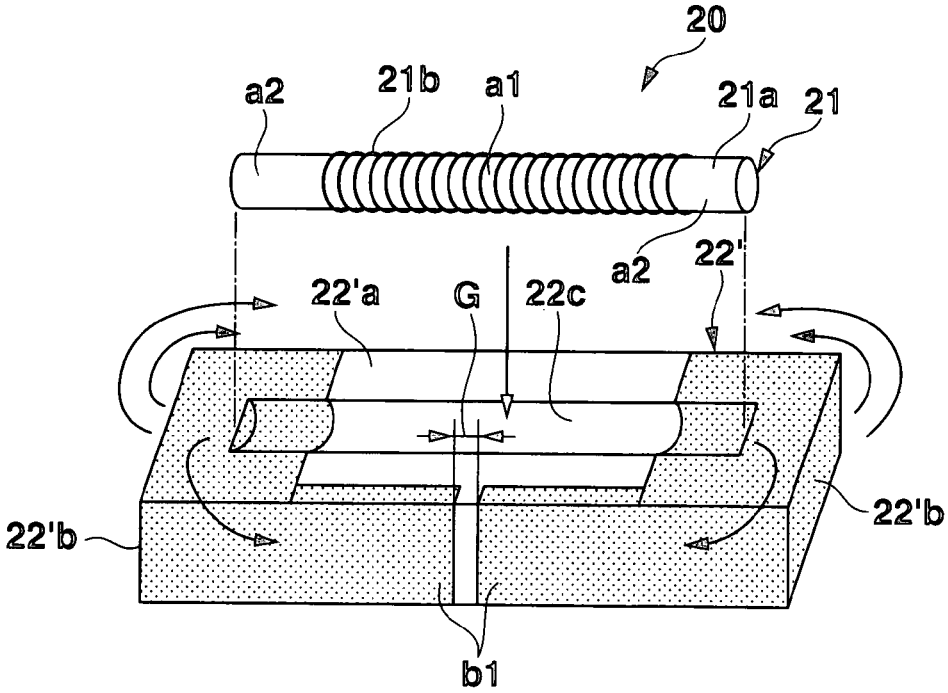
FIG. 14 is a perspective view showing in a simplified manner a structure of a third embodiment of the antenna device which is used in the radio wave controlled wristwatch of FIG. 1.

Next, referring to FIG. 14, an antenna device 20 according to a third embodiment will be explained. FIG. 14 shows in a simplified manner a configuration of the third embodiment of the antenna device 20 which is used in the radio wave controlled wristwatch 100 of FIG. 1.

The configuration of the antenna device 20 according to the present embodiment is similar to that of the antenna device 20 according to the first embodiment shown in FIG. 5 in a simplified manner. Therefore, in a configuration of the antenna device 20 according to the third embodiment, constituent elements which are the same as those of the antenna device 20 according to the first embodiment and shown in FIG. 5 in the simplified manner are designated by reference numerals which are the same as those designating the same constituent elements of the antenna device 20 according to the first embodiment. And, a detailed description thereof will be omitted.

The antenna device 20 according to the third embodiment is different from the simplified antenna device 20 according to the first embodiment in that one portion b1 of each of two magnetic portions 22'*b* at both sides of a non-magnetic portion 22'*a* in an antenna support member 22' is extended along one side of the non-magnetic portion 22'*a* so that the portions b1 of the two magnetic portions 22'*b* are in close proximity to each other, and extending ends of the portions b1 are opposed to each other with a slight gap G. In addition, the gap G is embedded with a portion of the non-magnetic portion 22'*a*.

The portions b1, extended so as to oppose to each other, of the two magnetic portions 22'*b* form a sub-magnetic path in the antenna support member 22'.

The sub-magnetic path functions as follows. When the antenna device 20 receives the standard time radio wave, magnetic fluxes are generated in a main magnetic path composed of the two magnetic portions 22'*b* and the core 21*a* both end portions of which are magnetically coupled with the two magnetic portions 22'*b* in the antenna device 20. And, when the magnetic fluxes tend to separate from the main magnetic path to a peripheral space thereof, the sub-magnetic path introduces the magnetic flux into itself to prevent the magnetic fluxes from separating from the main magnetic path to the peripheral space thereof. In this situation, the magnetic fluxes generated in the antenna device 20 is prevented from leaking out from the antenna device 20 to the metallic watch case 2, so that it possible to effectively restrain occurrence of an eddy current in the metallic watch case 2 and to restrain the lowering of receiving sensitivity of the antenna device 20.

In the antenna device 20 according to the third embodiment, it is preferable that magnetic permeability of the sub-magnetic path be lower than that of the main magnetic path. This prevents the magnetic fluxes which should pass the main magnetic path of the inside of the coil 21*b* of the antenna 21 from passing through the sub-magnetic path, and the antenna 21 is surely prevented from lowering its receiving sensitivity.

The antenna device and the radio wave controlled timepiece, both according to the present invention, are not limited to the embodiments and modifications described above. Various modifications and design changes can be made without departing from the spirit of the present invention.

For example, in the embodiments and modifications described above, the both end portions a2 of the core 21*a* of the antenna 21 are in contact with the two magnetic portions 22*b* of the antenna support member 22 or the two magnetic portions 22'*b* of the antenna support member 22' or the two magnetic portions 30*b* of the upper housing 30 as the antenna support member or the two magnetic portions 30'*b* of the upper housing 30' as the antenna support member or the two magnetic portions 30"*b* of the upper housing 30" as the antenna support member or the two antenna core support members 56 of the two magnetic portions 50*b* of the watch case 50 as the antenna support member, and are magnetically coupled with them.

However, even in a case where the both end portions a2 of the core 21*a* of the antenna 21 are not directly in contact with the two magnetic portions 22*b* of the antenna support member

22 or the two magnetic portions 22'*b* of the antenna support member 22' or the two magnetic portions 30*b* of the upper housing 30 as the antenna support member or the two magnetic portions 30'*b* of the upper housing 30' as the antenna support member or the two magnetic portions 30"*b* of the upper housing 30" as the antenna support member or the two antenna core support members 56 of the two magnetic portions 50*b* of the watch case 50 as the antenna support member, if magnetic fluxes more than a predetermined quantity can be flow between the both end portions a2 of the core 21*a* of the antenna 21 and the two magnetic portions with something being interposed therebetween, it can be called that they are magnetically coupled with each other.

Further, as a synthetic resin for forming each of the non-magnetic portion 22*a*, 22'*a*, 30*a*, 30'*a*, 30"*a* or 50*a*, and the magnetic portion 22*b*, 22'*b*, 30*b*, 30'*b*, 30"*b* and 50*b* may be selected from: an epoxy resin; a phenol resin; a melamine resin; a urea resin; an unsaturated polyester resin; a polyimide resin; a furan resin; a polybutadiene-type resin; an ionomer resin; an EEA resin; an AAS resin (ASA resin); an AS resin; an ACS resin; an ethylene vinyl acetate copolymer; an ethylene vinyl alcohol copolymer resin; an ABS resin; a vinyl chloride resin; polyethylene chloride resin; a acetate fiber material resin; a fluorine resin; a polyacetal resin; a polyamide resin 6; a polyamide resin 66; a polyamide resin 11; a polyamide resin 12; a polyarylate resin; a thermoplastic polyurethane elastomer; a liquid crystal polymer; polyether ether ketone; a polysulfone resin; a polyether sulfone resin; high density polyethylene; low density polyethylene; straight-chain low density polyethylene; polyethylene terephthalate; a polycarbonate resin; a polystyrene resin; a polyphenylene ether resin; a polyphenylene sulfide resin; a polybutadiene resin; a polypropylene resin; a polypropylene resin; a methacrylate resin; and a methylpentene polymer. Among them, an epoxy resin and a phenol resin are preferable from the viewpoints of thermal resistance, dimensional stability, strength, etc.

In the above described embodiments and modifications, the radio wave controlled wristwatches 100 and 200 are described as radio wave controlled timepieces. However, according to the present invention, the radio wave controlled timepiece may be a pocket watch, a wall clock or a table clock.

Further, the magnetic portion 22*b*, 22'*b*, 30*b*, 30'*b*, 30"*b* and 50*b* may be configured, instead of the resin that contains magnetic material, by adhering magnetic material on a surface of a synthetic resin member, or by burying a foil or plate of magnetic material in the synthetic resin member, or by adhering the foil or plate of magnetic material on the surface of the synthetic resin member.

Additional advantages and modifications will readily occur to those skilled in the art. Therefore, the invention in its broader aspects is not limited to the specific details and representative embodiments shown and described herein. Accordingly, various modifications may be made without departing from the sprit or scope of the general inventive concept as defined by the appended claims and their equivalents.

What is claimed is:

1. A radio wave controlled timepiece comprising:

a case which includes an inner space having an opening communicated with an outer space;

a light transmissible member which covers the opening of the case;

an antenna which is installed in the inner space of the case, and which includes an elongated core and a coil wound around a center portion of the core, wherein the antenna is configured to receive a radio wave including time information;

an antenna support member which is independent of the case and installed in the inner space of the case, and which includes two magnetic portions and a non-magnetic portion supporting the two magnetic portions independently of each other, wherein first and second end portions of the core of the antenna are magnetically coupled with the two magnetic portions, respectively;

a time counting unit which is held by the antenna support member in the inner space of the case, and which is configured to count a time;

a time display unit which is held by the antenna support member in the inner space of the case, and which is visible from the outer space through the light transmissible member, wherein the time display unit is connected to the time counting unit and is configured to display the time; and a time updating unit which is held by the antenna support member in the inner space of the case, and which is configured to update the time displayed on the time display unit, based on the time information included in the radio wave received by the antenna.

2. The radio wave controlled timepiece according to claim 1, wherein the two magnetic portions and the non-magnetic portion in the antenna support member are formed integrally with each other.

3. The radio wave controlled timepiece according to claim 1, wherein the two magnetic portions of the antenna support member are formed of a resin that contains magnetic material and the non-magnetic portion of the antenna support member is formed of a resin that does not contain magnetic material.

4. The radio wave controlled timepiece according to claim 3, wherein the two magnetic portions and the non-magnetic portion in the antenna support member are formed integrally with each other.

5. The radio wave controlled timepiece according to claim 1, wherein the two magnetic portions of the antenna support member are in contact with the first and second end portions of the core of the antenna, respectively.

6. The radio wave controlled timepiece according to claim 1, wherein the case is metallic.

7. A radio wave controlled timepiece comprising:

a case which includes an inner space having an opening communicated with an outer space;

a light transmissible member which covers the opening of the case;

an antenna which is installed in the inner space of the case, and which includes an elongated core and a coil wound around a center portion of the core, wherein the antenna is configured to receive a radio wave including time information;

an antenna support member which includes two magnetic portions and a non-magnetic portion supporting the two magnetic portions independently of each other, wherein first and second end portions of the core of the antenna are magnetically coupled with the two magnetic portions, respectively, and wherein the antenna support member comprises an integral part of the case;

a time counting unit which is held by the antenna support member in the inner space of the case, and which is configured to count a time;

a time display unit which is held by the antenna support member in the inner space of the case, and which is visible from the outer space through the light transmissible member, wherein the time display unit is connected to the time counting unit and is configured to display the time; and a time updating unit which is held by the antenna support member in the inner space of the case, and which is configured to update the time displayed on the time display unit, based on the time information included in the radio wave received by the antenna.

8. The radio wave controlled timepiece according to claim 7, wherein the two magnetic portions and the non-magnetic portion in the antenna support member are formed integrally with each other.

9. The radio wave controlled timepiece according to claim 7, wherein the two magnetic portions of the antenna support member are formed of a resin that contains magnetic material and the non-magnetic portion of the antenna support member is formed of a resin that does not contain magnetic material.

10. The radio wave controlled timepiece according to claim 9, wherein the two magnetic portions and the non-magnetic portion in the antenna support member are formed integrally with each other.

11. The radio wave controlled timepiece according to claim 7, wherein the two magnetic portions of the antenna support member are in contact with the first and second end portions of the core of the antenna, respectively.

* * * * *

UNITED STATES PATENT AND TRADEMARK OFFICE

CERTIFICATE OF CORRECTION

PATENT NO. : 7,515,112 B2
APPLICATION NO. : 11/714386
DATED : April 7, 2009
INVENTOR(S) : Kaoru Someya et al.

It is certified that error appears in the above-identified patent and that said Letters Patent is hereby corrected as shown below:

On the Title page:

Below item (76):

Insert --(73) Assignee: Casio Computer Co., Ltd. Tokyo (JP)--.

Signed and Sealed this

Ninth Day of June, 2009

John Doll

JOHN DOLL
*Acting Director of the United States Patent and Trademark Office*